US005881707A

United States Patent [19]

Gardner, Jr.

[11] Patent Number: 5,881,707

[45] Date of Patent: Mar. 16, 1999

[54] PNEUMATICALLY OPERATED PROJECTILE LAUNCHING DEVICE

[75] Inventor: William M. Gardner, Jr., Ligonier, Pa.

[73] Assignee: Smart Parts, Inc., Latrobe, Pa.

[21] Appl. No.: 783,064

[22] Filed: Jan. 15, 1997

Related U.S. Application Data

[63] Continuation-in-part of Ser. No. 586,960, Jan. 16, 1996, abandoned.

[51] Int. Cl.[6] ..... F41B 11/00

[52] U.S. Cl. ..... 124/77; 124/32

[58] Field of Search ..... 124/77, 32, 73, 124/54

[56] References Cited

U.S. PATENT DOCUMENTS

| | | | |
|---|---|---|---|
| 2,304,320 | 12/1942 | Tratsch | 124/77 |
| 2,568,432 | 9/1951 | Cook | 124/77 |
| 2,834,332 | 5/1958 | Guthrie | 124/77 |
| 2,845,805 | 7/1958 | Collins et al. | 124/77 |
| 3,089,476 | 5/1963 | Wolverton | 124/77 |
| 3,192,915 | 7/1965 | Norris et al. | 124/77 |
| 3,662,729 | 5/1972 | Henderson | 124/73 |
| 3,695,246 | 10/1972 | Filippi et al. | 124/77 |
| 3,921,980 | 11/1975 | Artzer | 124/77 |
| 4,770,153 | 9/1988 | Edelman | 124/77 |
| 4,819,609 | 4/1989 | Tippmann | 124/72 |
| 4,899,717 | 2/1990 | Rutten et al. | 124/32 |
| 4,936,282 | 6/1990 | Dobbins et al. | 124/74 |
| 5,228,427 | 7/1993 | Gardner, Jr. | 124/71 |
| 5,280,778 | 1/1994 | Kotsiopoulos | 124/73 |
| 5,285,765 | 2/1994 | Lee | 124/50 |
| 5,333,594 | 8/1994 | Robinson | 124/73 |
| 5,383,442 | 1/1995 | Tippmann | 124/76 |

*Primary Examiner*—J. Woodrow Eldred
*Attorney, Agent, or Firm*—Titus & McConomy LLP

[57] ABSTRACT

The pneumatically operated projectile launching device is preferably comprised of three principal elements: a body which houses and interconnects all of the pneumatic components and also houses the electrical power source, a grip mounted to the body which includes an electrical switch that activates a launching sequence, and an electrical control unit housed within both the body and the grip which directs flow between the pneumatic components to load, cock and fire the gun. The body preferably contains a plurality of chambers in communication with each other including a chamber containing and distributing pressurized gas, a chamber containing a compressed gas storage chamber and mechanisms for filling the storage chamber with gas and releasing gas from the storage chamber to fire the projectile, and a chamber containing mechanisms for loading and launching the projectile. The electrical control unit preferably includes an electrical power source which activates an electrical timing circuit when the electrical switch is closed, and two electrically operated pneumatic flow distribution devices. When the electrical switch is closed to initiate the launching sequence the projectile is first loaded into the launching mechanism by electrical timing circuit actuation of the first electrically operated pneumatic flow distribution device. The projectile is then fired when the electrical timing circuit actuates the second electrically operated pneumatic flow distribution device to release gas from the compressed gas storage chamber into the launching mechanism.

19 Claims, 4 Drawing Sheets

PNEUMATICALLY OPERATED PROJECTILE LAUNCHING DEVICE

CROSS REFERENCE

This application is a continuation-in-part (CIP) of U.S. patent application Ser. No. 08/586,960, filed Jan. 16, 1996 abandoned.

FIELD OF THE INVENTION

The present invention relates to a pneumatically operated projectile launching device. A preferred embodiment of the invention is designed for use in the recreational sport of "Paintball" (also known as "Survival" or "Capture the Flag".

BACKGROUND OF THE INVENTION

The current invention consists of a device for launching a projectile using pneumatic force. Guns using pneumatic force to propel a projectile are well known. In particular, it is well known to use pneumatic force to fire a fragile spherical projectile containing a colored, viscous substance (known as a "paintball") which bursts upon impact with a target. However pneumatically operated guns used in paintball applications (as well as existing pneumatically operated guns in general) suffer from several deficiencies affecting the accuracy of the shot which are eliminated by the present invention.

Existing pneumatically operated guns invariably use a spring mechanism in some fashion to aid in generating the propellent force necessary to fire the projectile at the desired velocity from the gun. The use of a spring creates a non-linear transformation of energy from a pneumatically stored potential form into kinetic acceleration of the projectile, since the spring releases continuously less energy as it expands from its maximum deformation to its undeformed natural state. In the case of any flexible projectile in general and particularly in the case of paintballs, this non-linear transformation of energy causes some deformation in the shape of the projectile that alters the ballistic forces created upon it in flight, adversely affecting the accuracy with which the projectile can be fired to strike its intended target. The adverse ballistic effects stemming from projectile deformation are particularly felt at the low projectile velocities required in paintball applications for player safety. Given the spring forces used in the existing state of the art, it is necessary to fire a paintball at the highest pneumatic pressures possible in order to eliminate these adverse ballistic effects. This has caused development of a thicker paintball shell to eliminate paintball breakage within the firing chamber of the gun. This increased thickness has in turn created a problem with paintball breakage as it impacts its target. To eliminate all of these problems without sacrificing player safety, it has become necessary in paintball applications to find a way to minimize projectile deformation at low pneumatic pressure levels, in order to permit the accurate sighting and firing of a low velocity shot.

The present invention solves all of these problems by eliminating the use of spring mechanisms in the transfer of energy to the projectile during the launching sequence. The invention uses a launching sequence which results in only the application of pneumatic force to the projectile. This creates a linear change in the amount of energy that is applied to the projectile as the pneumatically stored energy undergoes expansion and decompression upon release. This in turn minimizes the physical deformation of the projectile during the launching sequence, increasing the accuracy of the shot. In paintball applications, this linear application of force contributes greatly to increased accuracy, since a non-linear transfer of force at the low pressures required to limit paintball velocities to safe levels exaggerates the adverse ballistic effects on the paintball, due to its low velocity. A preferred embodiment of the present invention optionally provides electro-pneumatic control for both the projectile cocking and reloading operations to optimize firing sequence timing.

The accuracy of the present invention has been proven through testing at the projectile velocity levels used in paintball applications. Ten shot clusters from a conventional hand held paintball gun that is fired from a target distance of 60 yards typically exhibits an average maximum inaccuracy of 15 inches for projectile velocities in the 290 to 300 feet per second range. The same conventional paintball gun shot under the same conditions from a rigid mount typically exhibits an average maximum inaccuracy of 10 inches. In contrast, the present invention exhibited an average maximum inaccuracy of less than 8 inches when fired from a hand held position, and an average maximum inaccuracy of 4 inches when rigidly mounted.

The invention also provides increased aiming accuracy through the use of a cam shaped trigger and electrical switch arrangement to initiate the projectile launching sequence. This arrangement minimizes the pull force necessary to engage the switch by contact with the trigger, due to the mechanical advantage provided by the transfer of force through the cam. This in turn minimizes the amount of hand and arm movement experienced upon pulling the trigger, which increases firing accuracy.

Finally, the present invention also provides a significant accuracy advantage over all prior art spring-loaded guns at all pneumatic operating pressures, due to the minimized recoil experienced after a shot is fired. Typical spring-loaded guns exhibit greater recoil than does the invention, due to the non-linear reaction forces created on the gun body by the expansion of the spring. In contrast, the elimination of spring loading in the present invention eliminates these non-linear forces, minimizing the amount of recoil experienced and thus allowing greater accuracy over all types of existing spring-loaded gun designs in the firing of a shot.

Accordingly, it is an object of the present invention to provide a projectile launching device that uses only pneumatic force to propel a projectile.

It is also an object of the present invention to provide a projectile launching device for use in the recreational and professional sport of paintball that uses only pneumatic force to propel the paintball.

It is also an object of the present invention to provide a projectile launching device which can be aimed and fired with greater accuracy than all types of spring-loaded guns at all pneumatic operating pressures.

It is also an object of the present invention to provide a projectile launching device for use in the recreational and professional sport of paintball which can be aimed and fired with greater accuracy than existing paintball guns at low pneumatic operating pressures.

It is also an object of the present invention to provide a projectile launching device that uses electro-pneumatic control to release the pneumatic force that propels the projectile.

It is also an object of the present invention to provide a projectile launching mechanism that uses electro-pneumatic control for both the projectile cocking and reloading operations to optimize firing sequence timing.

It is also an object of the present invention to provide a projectile launching device for use in the recreational and professional sport of paintball that uses electro-pneumatic control to release the pneumatic force that propels the projectile.

SUMMARY OF THE INVENTION

The pneumatically operated projectile launching device is preferably comprised of three principal elements: a body which houses and interconnects all of the pneumatic components and also houses the electrical power source, a grip mounted to the body which includes an electrical switch that activates a launching sequence, and an electrical control unit housed within both the body and the grip which directs flow between the pneumatic components to load, cock and fire the gun.

The body preferably contains a plurality of chambers in communication with each other including a chamber containing and distributing pressurized gas, a chamber containing a compressed gas storage chamber and mechanisms for filling the storage chamber with gas and releasing gas from the storage chamber to fire the projectile, and a chamber containing mechanisms for loading and launching the projectile. The electrical control unit preferably includes an electrical power source which activates an electrical timing circuit when the electrical switch is closed, and at least two and preferably three electrically operated pneumatic flow distribution devices which are sequentially energized by the electrical timing circuit to enable the loading of a projectile for launching and to release compressed gas from the storage chamber to fire the projectile, respectively.

Before the initiation of a launching sequence the compressed gas storage chamber is filled with compressed gas while the projectile launching mechanism is disabled. Filling of the compressed gas storage chamber is preferably accomplished automatically by actuation of the compressed gas filling mechanism. When the electrical switch is closed to initiate the launching sequence the projectile is first loaded into the launching mechanism by electrical timing circuit actuation of the first electrically operated pneumatic flow distribution device. The projectile is then fired when the electrical timing circuit actuates the second electrically operated pneumatic flow distribution device to release gas from the compressed gas storage chamber into the launching mechanism. In the preferred embodiment, the third electrically operated pneumatic flow distribution device allows the reloading of a new projectile into the launching mechanism following the firing of the projectile.

The present invention eliminates the use of spring mechanisms in the transfer of energy to the projectile during the launching sequence. The invention uses a launching sequence which results in only the application of pneumatic force to the projectile. This creates a linear change in the amount of energy that is applied to the projectile as the pneumatically stored energy undergoes expansion and decompression upon release. This in turn minimizes the physical deformation of the projectile during the launching sequence, increasing the accuracy of the shot. In paintball applications, this linear application of force contributes greatly to increased accuracy, since a non-linear transfer of force at the low pressures required to limit paintball velocities to safe levels exaggerates the adverse ballistic effects on the paintball, due to its low velocity.

The accuracy of the present invention has been proven through testing at the projectile velocity levels used in paintball applications. Ten shot clusters from a conventional hand held paintball gun that is fired from a target distance of 60 yards typically exhibits an average maximum inaccuracy of 15 inches for projectile velocities in the 290 to 300 feet per second range. The same conventional paintball gun shot under the same conditions from a rigid mount typically exhibits an average maximum inaccuracy of 10 inches. In contrast, the present invention exhibited an average maximum inaccuracy of less than 8 inches when fired from a hand held position, and an average maximum inaccuracy of 4 inches when rigidly mounted.

The invention also provides increased aiming accuracy through the use of a cam shaped trigger and electrical switch arrangement to initiate the projectile launching sequence. This arrangement minimizes the pull force necessary to engage the switch by contact with the trigger, due to the mechanical advantage provided by the transfer of force through the cam. This in turn minimizes the amount of hand and arm movement experienced upon pulling the trigger, which increases firing accuracy.

Finally, the present invention also provides a significant accuracy advantage over all prior art spring-loaded guns at all pneumatic operating pressures, due to the minimized recoil experienced after a shot is fired. Typical spring-loaded guns exhibit greater recoil than does the invention, due to the non-linear reaction forces created on the gun body by the expansion of the spring. In contrast, the elimination of spring loading in the present invention eliminates these non-linear forces, minimizing the amount of recoil experienced and thus allowing greater accuracy over all types of existing spring-loaded gun designs in the firing of a shot.

DETAILED DESCRIPTION OF THE PREFERRED EMBODIMENT

The pneumatically operated projectile launching device is preferably comprised of three principal elements: a body which houses and interconnects all of the pneumatic components and also houses the electrical power source; a grip mounted to the body which includes a trigger and an electrical switch that activates the launching sequence; and an electrical control unit housed within both the body and the grip which directs flow between the pneumatic components to load, cock and fire the gun.

Figure 1:
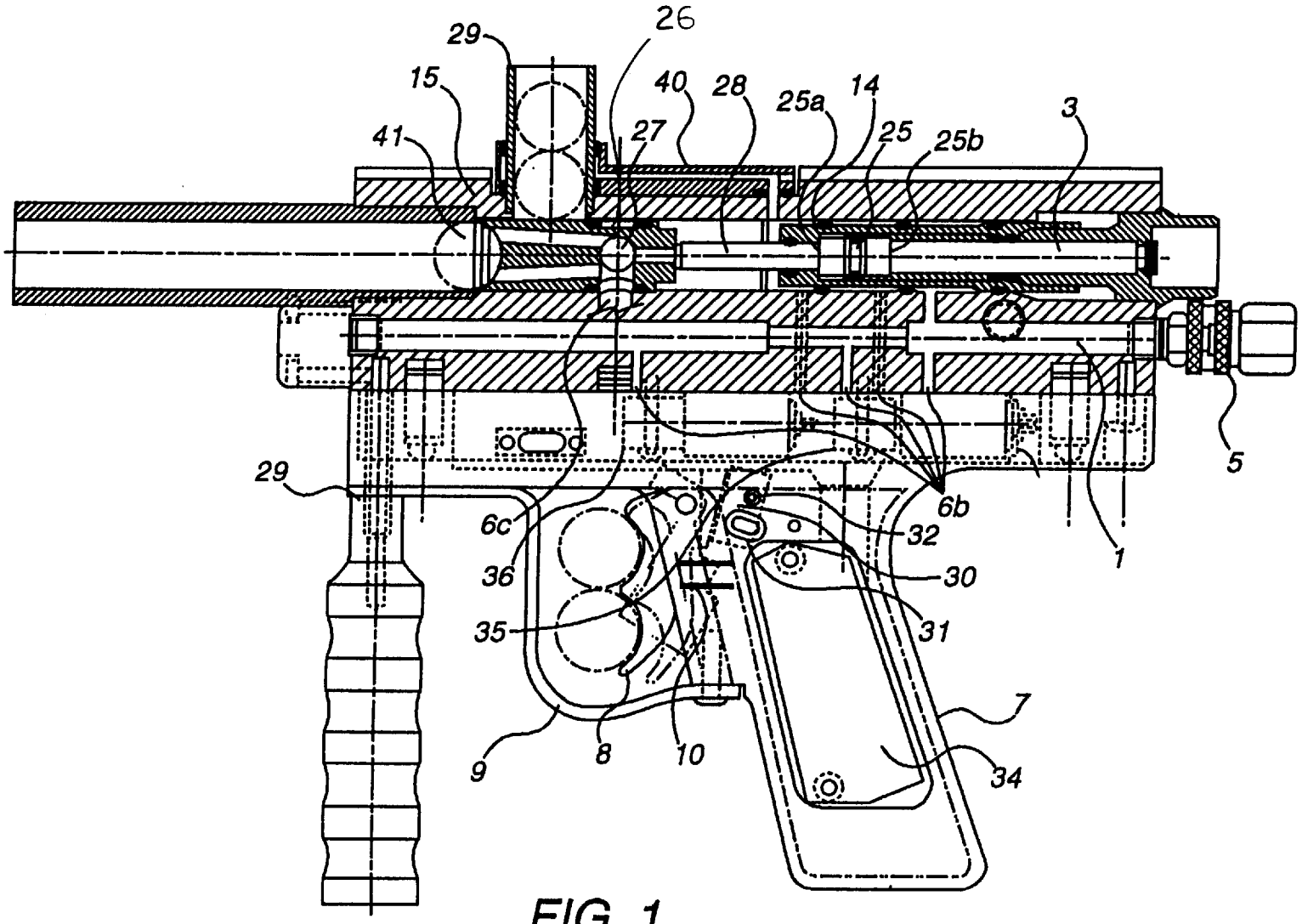
FIG. 1 is a side view of the pneumatically operated projectile launching device.
Figure 1A:
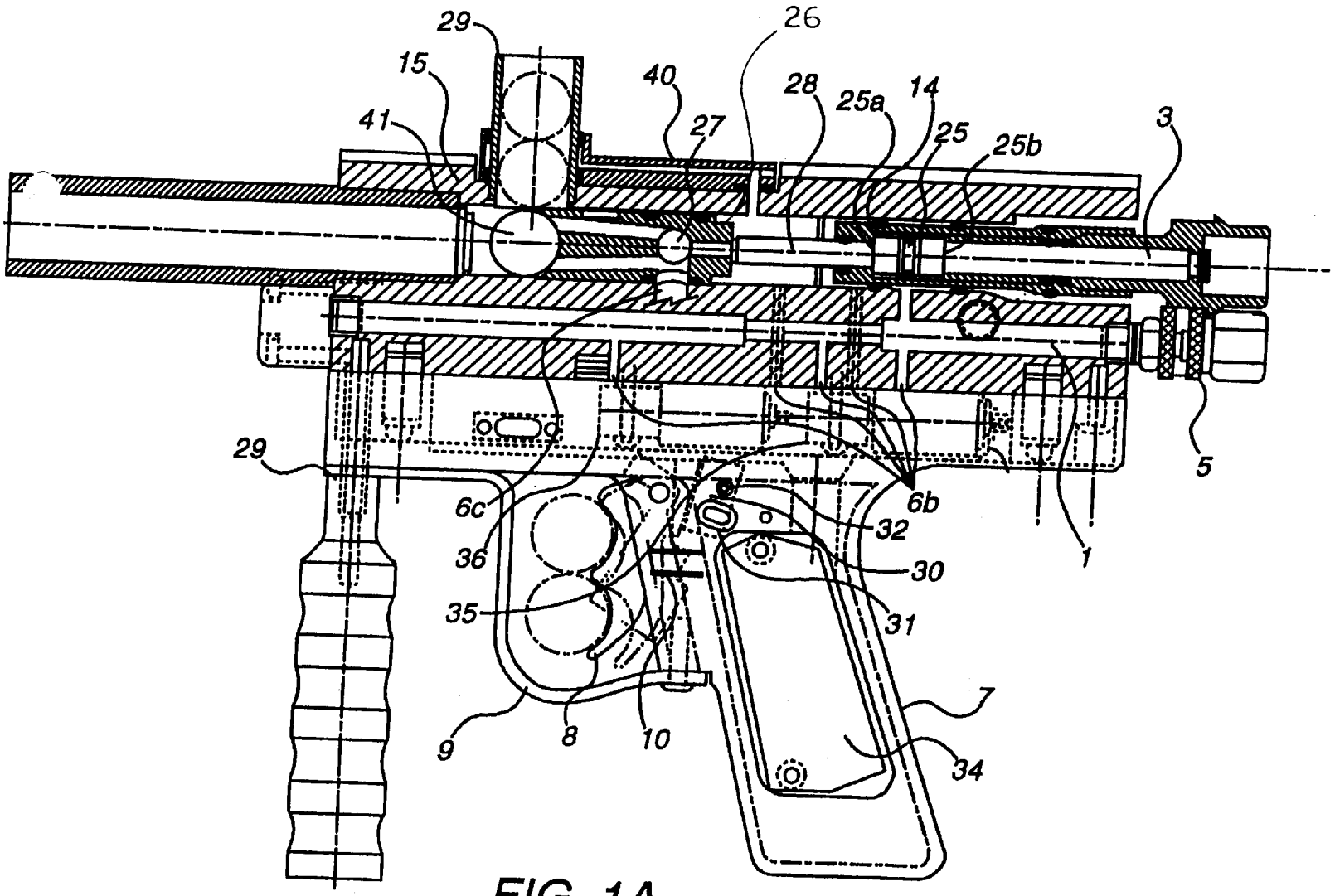
Figure 2:
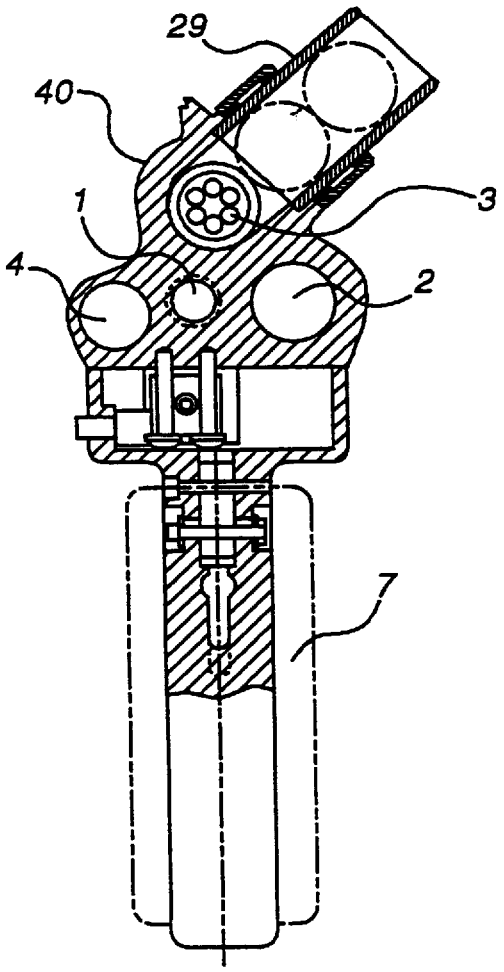
FIG. 2 is a rear view of the pneumatically operated projectile launching device.
Figure 3:
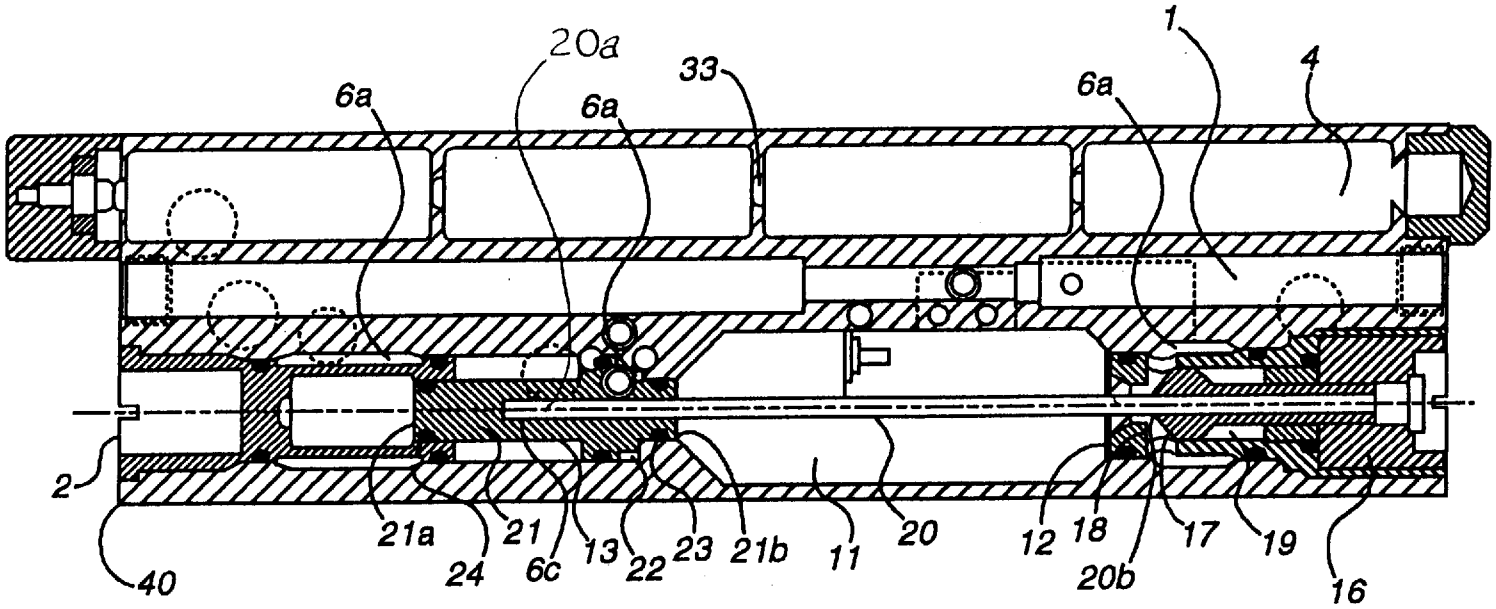
FIG. 3 is a top view of the body of the pneumatically operated projectile launching device.

As shown in FIG. 2, the body preferably has three pneumatic chambers with axes that are preferably parallel to the longitudinal axis of the gun body 40. The gun body 40 can be made of materials suitable in the art for withstanding the force of the launching sequence such as metal or plastic. The first chamber 1 contains compressed gas and is preferably sealed by a removable fitting 5 which is removed to inject the gas. The first chamber 1 is preferably in communication with the second chamber 2 and the third chamber 3 through a series of ported passageways 6*a* and 6*b*, respectively, bored through the interior of the gun body 40. As shown in FIG. 3, the second chamber 2 houses the compressed gas storage chamber 11, the compressed gas filling mechanism 12 and the compressed gas releasing mechanism 13. The third chamber 3 is also preferably in communication with both the first chamber 1 and the second chamber 2 through a series of ported passageways 6*b* and 6*c*, respectively, bored through the interior of the gun body 40. As shown in FIG. 1, the third chamber 3 houses the projectile loading mechanism 14 and the projectile launching mechanism 15.

As shown in FIG. 3, the compressed gas storage chamber 11 is bordered by the interior walls of the second chamber 2 and by the compressed gas filling mechanism 12 on one end and by the compressed gas releasing mechanism 13 on the end opposite the compressed gas filling mechanism 12. The compressed gas storage chamber 11 is filled with compressed gas from the first chamber 1 by means of the interconnections 6*a* between the first chamber 1 and the second chamber 2 when the compressed gas filling mechanism 12 is actuated. The compressed gas storage chamber 11 releases stored gas to the projectile launching mechanism 15 by means of the interconnections 6*c* between the second chamber 2 and the third chamber 3 when the compressed gas releasing mechanism 13 is actuated.

As shown in FIG. 3, the compressed gas filling mechanism 12 preferably consists of a valve 16 with a metallic or plastic conically or spherically shaped plug 17 which is normally shut against a metallic, plastic, or rubber conically or concavely shaped seat 18 by the loading of a spring 19 when the compressed gas filling mechanism 12 is not in its actuated position. The plug 17 is attached to a second end 20*b* of a metallic or plastic rod-shaped mechanical linkage 20 which opens the valve 16 by compressing the spring 19 when the compressed gas filling mechanism 12 is in its actuated position to create a flow path for compressed gas from the first chamber 1 to the compressed gas storage chamber 11.

As shown in FIG. 3, the mechanical linkage 20 passes through the compressed gas storage chamber 11 and has a first end 20*a* which is attached to the compressed gas releasing mechanism 13. The compressed gas releasing mechanism 13 preferably consists of a metallic or plastic piston 21 which slides along the longitudinal axis of the second chamber 2 in a space adjacent to the compressed gas storage chamber 11. A second end 21*b* of the piston 21 is adjacent to the compressed gas storage chamber 11 and is connected to the first end 20*a* of the mechanical linkage 20. The second end of the piston 21*b* has a flexible O-ring seal 23 made of rubber or other suitable synthetic sealing materials such as polyurethane that prevents gas leakage out of the compressed gas storage chamber 11. Compressed gas from the first chamber 1 is applied to the second end of the piston 21*b* to actuate the compressed gas releasing mechanism 13 by unseating the O-ring 23 sealing the compressed gas storage chamber 11 to allow stored gas to be released from the compressed gas storage chamber 11 into the projectile launching mechanism 15 by means of the interconnections 6*c* between the second chamber 2 and the third chamber 3. The piston 21 contains a notched area 22 adjacent to the O-ring 23 that provides a surface for applying compressed gas pressure from the first chamber 1 to unseat the O-ring 23 and actuate the compressed gas releasing mechanism 13.

The piston 21 has a first end 21*a* opposite the compressed gas storage chamber 11 which is subjected to pneumatic pressure to actuate the compressed gas filling mechanism 12 by transmitting through the mechanical linkage 20 a compression force on the spring 19 that opens the valve 16. The opening in the valve 16 is formed when the plug 17 is separated from the seat 18 to create a flow path for compressed gas from the first chamber 1 to the compressed gas storage chamber 11 by means of the interconnections 6*a* between the first chamber 1 and the second chamber 2. Compressed gas from the first chamber 1 is applied to the first end of the piston 21*a* to open the valve 16 and actuate the compressed gas filling mechanism 12. The first end of the piston 21*a* also contains a flexible O-ring seal 24 which prevents actuating pressure leakage into the compressed gas storage chamber 11 when the compressed gas filling mechanism 12 is actuated.

As shown in FIG. 1, the third chamber 3 of the gun body 40 houses the projectile loading mechanism 14 and the projectile launching mechanism 15. The projectile loading mechanism 14 preferably consists of a metallic or plastic piston 25 which slides along the longitudinal axis of the third chamber 3. The projectile launching mechanism 15 preferably consists of a metallic or plastic bolt 26 which also slides along the longitudinal axis of the third chamber 3 and which has a port 27 for receiving released gas from the compressed gas storage chamber 11 to propel a projectile 41 from the gun body 40. The bolt 26 is connected to the piston 25 by a metallic or plastic rod-shaped mechanical linkage 28, which moves the bolt 26 to receive the projectile 41 by gravity loading from the projectile feed mechanism 29 when the projectile loading mechanism 14 is actuated.

The projectile loading mechanism 14 is actuated when compressed gas from the first chamber 1 is applied by means of the interconnections 6*b* between the first chamber 1 and the third chamber 3 to a first end 25*a* of the piston 25 which is attached to the mechanical linkage 28. This compressed gas acts against the piston 25 and the mechanical linkage 28 to drive the bolt 26 back to the cocked position which enables the loading of a projectile 41 into engagement with the bolt 26 from the projectile feed mechanism 29. The subsequent release of stored gas from the compressed gas storage chamber 11 through the bolt port 27 will drive the projectile 41 from the gun body 40. After the launching sequence has been completed compressed gas is applied from third solenoid valve 37 to a second end 25*b* of the piston 25 opposite the mechanical linkage 28 to disable the bolt 26 from receiving a projectile 41 by driving the bolt 26 to the shut position.

The second principal element is the grip, shown in FIG 1. The grip is mounted to the body and preferably houses three principal components, a handle 7, a trigger 8 and an electrical switch 30. The handle 7 can be made of any suitable material such as metal or plastic and is preferably shaped with a hand grip to allow the gun to be held in a pistol-like fashion. The metallic or plastic trigger 8 is attached to the handle 7 and preferably has a leading edge shaped to be pulled by two fingers with a cam shaped trailing edge to engage the electrical switch 30. A trigger guard 9 which prevents accidental trigger displacement is preferably attached to the trigger 8. A spring 10 preferably returns the trigger 8 to a neutral position after the electrical switch 30 has been contacted to initiate a launching sequence. The electrical switch 30 is preferably a two-pole miniature switch which contains a plunger 31 loaded by a spring 32.

As shown in FIG. 1, the third principal element is the electrical control unit which is housed within both the body and the grip. The electrical control unit preferably consists of an electrical timing circuit 34 housed in the handle 7 along with three electrically operated 3-way solenoid valves 35, 36 and 37 housed in the gun body 40 and an electrical battery power source 33 housed in a fourth chamber 4 of the gun body 40. The electrical timing circuit 34 is a network of electronic components that includes two solid state integrated circuit timers which control the launching sequence by sending energizing pulses to the solenoid valves 35, 36 and 37, which function as electrically operated pneumatic flow distribution mechanisms. When actuated the solenoid valves 35 and 36 pass compressed gas flow from the first chamber 1 and when not actuated the solenoid valves 35 and 36 operate to vent gas from the pressurized area. Conversely, when actuated solenoid valve 37 vents compressed gas flow from pressurized area and and when not actuated solenoid valve 37 passes pressurized gas from the first chamber 1. Upon initiation of the launching sequence the electrical timing circuit 34 energizes each solenoid valve 35, 36 or 37 separately in a timed sequence to ensure that each solenoid valve 35, 36 or 37 either passes or vents pressurized gas at the appropriate time within the launching sequence to propel a projectile 41 from the gun body 40. In an alternate embodiment, three-way solenoid valves 36 and 37 may be replaced if desired with a single four-way solenoid valve which is capable of accomplishing the functions provided by both three-way solenoid valves 36 and 37.

DETAILED DESCRIPTION OF OPERATION

Before the initiation of a launching sequence the introduction of compressed gas into the first chamber 1 will preferably automatically cause pneumatic pressure to be applied to the first end of piston 21*a* to cause gas flow from the first chamber 1 to the compressed gas storage chamber 11 through actuation of the compressed gas filling mechanism 12 as described above. Simultaneously pneumatic pressure will preferably be applied by third solenoid 37 to the second end of piston 25*b* driving the bolt 26 to the shut position to disable the loading of a projectile 41. When these conditions are met the compressed gas storage chamber 11 is charged with the bolt 26 closed and the gun is ready for the initiation of a launching sequence.

A launching sequence is preferably initiated when the electrical switch 30 completes a circuit between the electrical power source 33 and the electrical timing circuit 34 as the cam shaped trailing edge of the trigger 8 contacts the plunger 31 to compress the spring 32. When contact is made the electrical power source 33 energizes the electrical timing circuit 34 which first sends an energizing pulse to actuate second solenoid valve 36 which then passes pressurized gas flow to the second end of piston 21*b* to actuate the compressed gas releasing mechanism 13. Subsequently, the electrical power source 33 energizes the electrical timing circuit 34 to send an energizing pulse to actuate first and third solenoid valves 35 and 37. When actuated the first solenoid valve 35 passes pressurized gas flow to the first end of piston 25*a* to actuate the projectile loading mechanism 14 by driving the bolt 26 back to the cocked position and to enable the loading of a projectile 41 into engagement with the bolt 26 from the projectile feed mechanism 29. Simultaneously, third solenoid valve is actuated to vent the pressurized gas from behind the second end of piston 25*a* to allow the bolt 26 to be placed in the cocking position. The electrical timing circuit 34 then sends an energizing pulse to actuate the second solenoid valve 36 which then passes pressurized gas flow to the second end of piston 21*b* to actuate the compressed gas releasing mechanism 13. Simultaneously the first solenoid valve 35 returns to its non-actuated position to vent the first end of piston 25*a*. This venting in combination with the actuation of the compressed gas releasing mechanism 13 allows the stored gas released into the bolt port 27 from the compressed gas storage chamber 11 to drive the projectile 41 from the gun body 40.

After the launching sequence has been completed the cocking sequence described above takes place automatically prior a subsequent firing of the trigger to launch the next projectile.

The launching sequence may then be repeated as many as nine times per second. The volume of the compressed gas storage chamber 11 and the chamber interconnections 6 are preferably sized to produce projectile velocities in the 290 to 300 feet per second range at an operating gas pressure of approximately 125 pounds per square inch gauge pressure. However, the 1.5 cubic inch volume of the compressed gas storage chamber 11 and the 0.0315 square inch area of the chamber interconnection orifices 6 will allow operation of the preferred embodiment at gas pressures of up to 175 pounds per square inch gauge pressure. As will be obvious to one skilled in the art, these parameters may be varied in order to allow for a differing operating gas pressure or projectile velocity.

While presently preferred embodiments have been shown and described in particularity, the invention may be otherwise embodied within the scope of the appended claims.

What is claimed is:

1. A pneumatically operated device for launching a projectile comprising:

A. a body having a plurality of chambers including:
- (i) a first chamber containing compressed gas;
- (ii) a second chamber in communication with said first chamber having:
  - (a) a compressed gas storage chamber for storing said compressed gas;
  - (b) a compressed gas filling mechanism for filling said compressed gas storage chamber;
  - (c) a compressed gas releasing mechanism for releasing said compressed gas from said compressed gas storage chamber to fire said projectile;
- (iii) a third chamber in communication with said first chamber and said second chamber having:
  - (a) a projectile launching mechanism for launching said projectile;
  - (b) a projectile loading mechanism for in communication with a source of projectiles for loading said projectiles into said projectile launching mechanism;

B. a grip including an electrical switch;

C. an electrical control unit comprising:
- (i) an electrical timing circuit electrically connected to said electrical switch for actuation thereby;
- (ii) first and third electrically operated pneumatic flow distribution mechanisms electrically connected to said timing circuit for actuation thereby, said first and third distribution mechanisms each being positionable between:
  - (a) a first position in which said projectile launching mechanism is prevented from receiving said projectile;
  - (b) a second position which enables said projectile launching mechanism to receive said projectile;
- (iii) a second electrically operated pneumatic flow distribution mechanism electrically connected to said timing circuit for actuation thereby, said second distribution mechanism being positionable between:
  - (a) a first position which enables said compressed gas storage chamber to be filled with said compressed gas;
  - (b) a second position which enables release of said compressed gas from said compressed gas storage chamber to launch said projectile;
- (v) an electrical power source connected to said electrical switch.

2. The pneumatically operated gun of claim 1 wherein:

A. said first electrically operated pneumatic flow distribution mechanism is actuated by said timing circuit from said first position to said second position to direct said compressed gas from said first chamber such that:

(i) said projectile loading mechanism is disabled to prevent said projectile launching mechanism from receiving said projectile when said first electrically operated pneumatic flow distribution mechanism is in said first position;

(ii) said projectile loading mechanism is actuated to enable said projectile launching mechanism to receive said projectile when said first electrically operated pneumatic flow distribution mechanism is in said second position;

B. said second electrically operated pneumatic flow distribution mechanism is actuated by said timing circuit from said first position to said second position to direct said compressed gas from said first chamber such that:

(i) said compressed gas filling mechanism is actuated to fill said compressed gas storage chamber when said second electrically operated pneumatic flow distribution mechanism is in said first position;

(ii) said compressed gas releasing mechanism is actuated to release said gas from said compressed gas storage chamber into said projectile launching mechanism to launch said projectile when said second electrically operated flow distribution mechanism is in said second position by redirecting said compressed gas away from said projectile loading mechanism; and C. said third electrically operated pneumatic flow distribution mechanism is actuated by said timing circuit from said first position to said second position to direct said compressed gas from said first chamber such that:

(i) said projectile loading mechanism is disabled to prevent said projectile launching mechanism from receiving said projectile when said third electrically operated pneumatic flow distribution mechanism is in said first position;

(ii) said projectile loading mechanism is actuated to enable said projectile launching mechanism to receive said projectile when said third electrically operated pneumatic flow distribution mechanism is in said second position.

3. A pneumatically operated device for launching a projectile comprising:

A. a body having a plurality of bores including:

(i) a first bore containing compressed gas;

(ii) a second bore in communication with said first bore having:

(a) a compressed gas storage chamber for storing said compressed gas;

(b) a compressed gas filling mechanism for filling said compressed gas storage chamber;

(c) a compressed gas releasing mechanism for releasing said compressed gas from said compressed gas storage chamber to fire said projectile;

(iii) a third bore in communication with said first bore and said second bore having:

(a) a projectile launching mechanism for launching said projectile;

(b) a projectile loading mechanism for in communication with a source of projectiles for loading said projectiles into said projectile launching mechanism;

B. a grip including an electrical switch;

C. an electrical control unit comprising:

(i) an electrical timing circuit electrically connected to said electrical switch for actuation thereby;

(ii) a first electrically operated pneumatic flow distribution mechanism electrically connected to said timing circuit for actuation thereby, said first distribution mechanism being positionable between:

(a) a first position in which said projectile launching mechanism is prevented from receiving said projectile;

(b) a second position which enables said projectile launching mechanism to receive said projectile;

(iii) a second electrically operated pneumatic flow distribution mechanism electrically connected to said timing circuit for actuation thereby, said second distribution mechanism being positionable between:

(a) a first position which enables said compressed gas storage chamber to be filled with said compressed gas;

(b) a second position which enables release of said compressed gas from said compressed gas storage chamber to launch said projectile; and (iv) an electrical power source connected to said electrical switch;

wherein said first electrically operated pneumatic flow distribution mechanism is a four-way valve.

4. The pneumatically operated gun of claim 3 wherein:

A. said first electrically operated pneumatic flow distribution mechanism is actuated by said timing circuit from said first position to said second position to direct said compressed gas from said first bore such that:

(i) said projectile loading mechanism is disabled to prevent said projectile launching mechanism from receiving said projectile when said first electrically operated pneumatic flow distribution mechanism is in said first position;

(ii) said projectile loading mechanism is actuated to enable said projectile launching mechanism to receive said projectile when said first electrically operated pneumatic flow distribution mechanism is in said second position;

B. said second electrically operated pneumatic flow distribution mechanism is actuated by said timing circuit from said first position to said second position to direct said compressed gas from said first bore such that:

(i) said compressed gas filling mechanism is actuated to fill said compressed gas storage chamber when said second electrically operated pneumatic flow distribution mechanism is in said first position;

(ii) said compressed gas releasing mechanism is actuated to release said gas from said compressed gas storage chamber into said projectile launching mechanism to launch said projectile when said second electrically operated flow distribution mechanism is in said second position by redirecting said compressed gas away from said projectile loading mechanism.

5. The pneumatically operated gun of claim 1 or 3 wherein said compressed gas filling mechanism comprises:

A. a valve adjacent to said compressed gas storage chamber having a plug and having a spring which loads said plug to shut said valve when said compressed gas filling mechanism is not actuated; and B. a mechanical linkage having a first end passing through said compressed gas storage chamber and having a second end attached to said plug which opens said valve when said compressed gas filling mechanism is actuated to create a flow path for said compressed gas from said first chamber to said compressed gas storage chamber.

6. The pneumatically operated gun of claim 5 wherein said compressed gas releasing mechanism is comprised of a first piston which slides longitudinally within said second chamber adjacent to said compressed gas storage chamber wherein:

A. said first piston has a first end which is pressurized by said compressed gas from said first chamber to actuate said compressed gas filling mechanism wherein:

(i) said first end has a flexible seal that prevents gas leakage into said compressed gas storage chamber from said first end;

B. said first piston has a second end adjacent to said compressed gas storage chamber which is pressurized by said compressed gas from said first chamber to actuate said compressed gas releasing mechanism wherein:

(i) said second end has a flexible seal that prevents gas leakage out of said compressed gas storage chamber from said second end;

(ii) said second end of said first piston is attached to said first end of said mechanical linkage such that said compressed gas filling mechanism is actuated when said first end of said first piston is pressurized by said compressed gas from said first chamber.

7. The pneumatically operated gun of claim 1 or 3 wherein said projectile launching mechanism is comprised of a bolt which slides longitudinally within said third chamber wherein said bolt has at least one port for receiving said release of said gas from said compressed gas storage chamber to launch said projectile.

8. The pneumatically operated gun of claim 7 wherein said projectile loading mechanism is comprised of a second piston which slides longitudinally within said third chamber wherein:

A. said second piston has a first end mechanically linked to said bolt which is pressurized by said compressed gas from said first chamber to actuate said projectile loading mechanism;

B. said second piston has a second end which is pressurized by said compressed gas from said first chamber to disable said projectile loading mechanism.

9. The pneumatically operated gun of claim 1 or 3 wherein said electrically operated pneumatic flow distribution mechanisms comprise solenoid valves.

10. The pneumatically operated gun of claim 1 or 3, wherein said communication between said chambers comprises ported passageways through the interior of said body.

11. The pneumatically operated gun of claim 1 or 3, wherein said gun is operated at gas pressures from about 125 pounds per square inch to about 175 pounds per square inch.

12. The pneumatically operated gun of claim 1 or 3 further comprising a removable means for sealing said first chamber after the insertion of compressed gas into said first chamber.

13. The pneumatically operated gun of claim 1 or 3 wherein said grip further comprises:

A. a handle; and

B. a trigger attached to said handle and operably connected to said electrical switch to actuate said electrical switch.

14. The pneumatically operated gun of claim 13 wherein said grip further comprises a spring to separate said trigger from said electrical switch when said trigger is released.

15. A method for pneumatically launching a projectile from a launching device having at least first and second interconnected chambers, comprising the following steps:

A. filling said first chamber of said launching device with compressed gas having a selected pressure;

B. launching said projectile from said second chamber by releasing said compressed gas from said first chamber into said second chamber; and C. loading a projectile into said second chamber.

16. The method of claim 15, wherein said filling step and said loading step are performed simultaneously, followed by said launching step.

17. The method of claim 15, wherein said loading step is followed by said launching step followed by said filling step.

18. The method of claim 15, 16 or 17, wherein said steps are repeated continuously.

19. The method of claim 15, wherein said selected gas pressure is between about 125 pounds per square inch and 175 pounds per square inch.

* * * * *

UNITED STATES PATENT AND TRADEMARK OFFICE
Certificate

Patent No. 5,881,707 Patented: March 16, 1999

On *petition* requesting issuance of a certificate for correction of inventorship pursuant to 35 U.S.C. 256, it has been found that the above-identified patent, through error and without deceptive intent, improperly sets forth the inventorship.

Accordingly, it is hereby certified that the correct inventorship of this patent is: William M. Gardner, Jr., Ligonier, PA; Adam Gardner, Ligonier, PA; David L. Smith, E. Aurora, NY; and Raymond S. Gaston, Lancaster, NY.

Signed and Sealed this Tenth Day of April, 2001.

PETER M. POON
*Supervisory Patent Examiner*
Art Unit 3644

UNITED STATES PATENT AND TRADEMARK OFFICE

CERTIFICATE OF CORRECTION

PATENT NO. : 5,881,707
DATED : March 16, 1999
INVENTOR(S) : William M. Gardner, Jr.

It is certified that error appears in the above-identified patent and that said Letters Patent is hereby corrected as shown below:

Title page,
Item [63] Related U.S. Application Data , in the application data please delete the word "abandoned" after January 16, 1996.

Column 1,
Line 7, please delete the word "abandoned".

Signed and Sealed this

Eighteenth Day of September, 2001

*Attest:*

Nicholas P. Godici

*Attesting Officer*

NICHOLAS P. GODICI
*Acting Director of the United States Patent and Trademark Office*